US006003827A

United States Patent [19]

Kulp et al.

[11] Patent Number: 6,003,827

[45] **Date of Patent: *Dec. 21, 1999**

[54] UNIVERSAL SIGN HOLDER

[75] Inventors: Jack H. Kulp, San Juan Capistrano; Samuel J. Bechtle, San Clemente, both of Calif.; John D. McKenney, Arroyo Seco, N.Mex.

[73] Assignee: Traffix Devices, Inc., San Clemente, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/924,437

[22] Filed: Aug. 27, 1997

[51] Int. Cl.[6] ..... G09F 7/02

[52] U.S. Cl. ..... 248/534; 40/606; 40/611; 40/612; 248/176.1; 248/539

[58] Field of Search ..... 248/518, 529, 248/534, 539, 176.1; 40/606, 610, 611, 612

[56] References Cited

U.S. PATENT DOCUMENTS

| | | | |
|---|---|---|---|
| 2,167,564 | 7/1939 | Fonda | 40/606 |
| 2,882,080 | 4/1959 | Burns | 248/539 X |
| 4,309,836 | 1/1982 | Knapp | 40/612 X |
| 4,426,800 | 1/1984 | Brown . | |
| 4,488,894 | 12/1984 | Sikorski et al. . | |
| 4,490,934 | 1/1985 | Knapp . | |
| 4,888,894 | 12/1989 | Brown, Jr. . | |
| 4,980,984 | 1/1991 | Kulp et al. . | |
| 5,318,258 | 6/1994 | Lang | 40/606 X |
| 5,438,782 | 8/1995 | Belobraydich et al. | 40/610 |
| 5,446,984 | 9/1995 | Kulp et al. . | |
| 5,472,162 | 12/1995 | Mason | 40/606 X |
| 5,611,509 | 3/1997 | Kulp et al. . | |
| 5,725,186 | 3/1998 | Hillstrom et al. | 40/606 X |

*Primary Examiner*—Derek J. Berger
*Attorney, Agent, or Firm*—Stout, Uxa, Buyan & Mullins, LLP; Donald E. Stout

[57] ABSTRACT

A universal sign holder for mounting and supporting a display sign on a sign supporting base. The universal sign holder is configured for direct connection to a conventional sign supporting base which has a plurality of outwardly extending support legs. The universal sign holder includes a mast which has a lower section and an upper section. A support platform is attached to the mast for retaining a lower edge of the display sign. An alignment bracket is provided above the support platform and is also secured to the mast. The alignment bracket is used to prevent lateral movement and rotation of the display sign relative to the mast. A retaining device is used to secure the vertical frame member against the mast and within the alignment bracket such that the display sign is secured and maintained in proper display position.

17 Claims, 2 Drawing Sheets

UNIVERSAL SIGN HOLDER

FIELD OF THE INVENTION

This invention relates generally to sign holding devices for supporting display signs and message display devices and more particularly, to a universal sign holder for use with a wide variety of such display signs and message devices.

BACKGROUND OF THE INVENTION

Signs and message display devices for displaying messages, warnings and other information are well known in the art. In particular, signs utilized for highway safety and construction related applications are in widespread use to advise motorists and others of temporary or emergency conditions along roadways and other locations. These signs are usually intended for relatively temporary placement at particular locations where repair or rebuilding of the roadway is taking place, or where other safety conditions arise. Such signs are preferably portable, so that they can easily be removed or relocated as the temporary traffic or other conditions change.

Highway and construction related signs intended for temporary use typically comprise a message panel bearing an appropriate warning or other message and a separate sign supporting base or stand for supporting and displaying the message panel. A sign holding device is used to support or hold the message panel relative to the sign supporting base. The message panels may be of the rigid type, constructed of a metal, a plywood, or the like, or may be of the flexible type, constructed of a fabric, a plastic, or other flexible material, and designed to roll up, fold or otherwise break down for transportation and storage when not in use. The use of flexible message panels has greatly increased in recent years due to their increased portability and simplified handling demands.

These flexible message panels typically include a more rigid frame, such as a frame having a plurality of frame members which extend from one edge of the message panel across to an opposing edge. In particular, the frame may consist of a pair of crossed, horizontal and vertical frame members or battens, which are usually made from a fiberglass or other similar material. The battens may be of various sizes, depending upon the size of the message panel, but the horizontal batten typically has a standard width of approximately 1.25 inches and a standard thickness of approximately 0.375 inches or less. The combination of the message panel and the frame are commonly referred to as the sign.

The signs may be of any shape such as diamond, square, rectangular, octagonal, triangular or circular, and may be of varying sizes, generally depending upon the distance from which the signs must generally be viewed. Regardless of the shape and size, each sign conventionally includes a vertical frame member or batten as previously described.

The sign supporting base upon which the sign is mounted is typically a standardized or conventional supporting base. These support bases are designed and constructed so that one person can readily move them from a truck or other supply vehicle to a particular location. Commonly, these support bases are collapsible or foldable such that they occupy less space when stored or handled. In this configuration, the support base may include a number of individual ground engaging legs to support a central base and which are foldable to reduce the overall storage and transportation space required.

A sign post or upright portion usually extends upwardly from the lower portion of the supporting base. This upright portion is used to actually support the sign. Alternatively, some sign supporting bases include a central base for attachment of a separate upright portion. The upright portions may be of various cross-sectional sizes, shapes and lengths. The most common cross-section is square, though other cross-sections, such as round, may occasionally be used. They are often telescopic in nature, being of different sizes at vertical locations.

A typical sign supporting base is disclosed in U.S. Pat. No. 5,611,509 to Kulp et al., issued Mar. 18, 1997, and expressly incorporated herein by reference. The present invention is adaptable to function in conjunction with any conventional sign supporting base, but is preferably used with a supporting base having a relatively short upright portion.

The attachment of the sign to the upright portion of the sign supporting base requires the use of a sign holder or other mounting bracket. Because of the multitude of different sign types and sizes, as well as the number of various different sign supporting bases, a unique sign holder is often required for each sign or alternatively, each sign supporting base.

In an effort to reduce the number of differing sign holders, adjustable sign holders have recently become available. These adjustable sign holders facilitate the adaptation of most any sign to a single type of sign supporting base. This reduces the number of components necessary at a particular location while increasing the available sign and message options. Several different types of these adjustable sign holders are currently available for use with flexible and roll-up signs.

For example, one prior art adjustable sign holder for use with flexible signs, comprises an integral one-piece unit having a square tube mounting portion which is adapted to slide over and be secured on the upright portion of the sign supporting base. Extending forwardly from the mounting portion is a sign receiving portion, comprising a pair of arms with slots for receiving the sign's horizontal frame member. A latching member in conjunction with a biasing spring is used to retain the horizontal batten which is inserted into the slots.

This adjustable sign holder functions adequately, but is awkward to manipulate and not very adaptable to different types of signs and sign supporting bases. The number of springs and pivoting elements are susceptible to failure and the loss of the otherwise secured sign. Furthermore, the sign receiving portion is also awkward and difficult to operate, requiring one to manually pivot the latching member rearwardly and hold it there, with one hand, against the spring bias, while using the other hand to manipulate the sign's horizontal batten into the two corresponding receiving slots. This difficulty is increased in windy or other adverse conditions. Other prior art sign holders have similar problems.

What is needed, therefore, is a universal sign holder for use with a wide variety of different signs, message display devices, and the like. Ideally, the universal sign holder will require little or no adjustments, should be easy to install and operate and should provide secure attachment to a conventional sign supporting base. The universal sign holder should also be inexpensive to manufacture. Furthermore, the universal sign holder should be simple and quick to install in the field, by one person, and should be capable of positively securing the sign in position, in any reasonable environmental condition.

SUMMARY

The present invention solves the aforementioned problems of the prior art by providing a universal sign holder which may be used to mount a sign or the like on a conventional sign supporting base, which is quick and easy to use, requires no tools and is relatively inexpensive to fabricate. The universal sign holder of the present invention utilizes an elongate mast assembly which is secured to the upright portion or post of a conventional sign supporting base. Thus, the need for a telescoping or long vertical upright portion is eliminated. This reduces the overall size of the required sign supporting base and increases its overall portability. In addition, the elongate mast assembly is advantageously configured for supporting and resisting relative lateral and rotational movement of the sign. When installed, the universal sign holder attaches and properly displays most any highway or construction type sign to the supporting base and particularly, flexible signs having a conventional vertical batten or similar vertical frame member.

More specifically, a universal sign holder is provided for mounting a display sign having a message panel supported by a vertical frame member. The universal sign holder comprises an elongate mast which includes a lower section and an upper section. The lower section is adapted for connection with a sign supporting base. The upper section is configured such that it extends vertically upwardly from the base. An alignment bracket is attached to the mast. The alignment bracket is used to retain the vertical frame member from moving laterally or rotating relative to the mast. A retaining clamp is used to retain the frame member against the mast as well as within the alignment bracket.

In another aspect of the present invention, a universal sign holder is provided for mounting a display sign which includes a message panel supported by at least one vertical frame member. The universal sign holder comprises an elongate mast which has a lower section and an upper section. The lower section is adapted for connection with an upright portion on a sign supporting base. The upper section extends upwardly and away from the sign supporting base.

The mast is advantageously configured with a slight angle, wherein the lower section is oriented along a first axis and the upper section is oriented along a second axis. This angle, between the first and second axes, is preferably between two and ten degrees, and allows the message panel to be advantageously oriented relative to the vertical.

An alignment bracket is attached to the mast adjacent an upper end of the upper section. In addition, the alignment bracket is spaced apart from the mast to provide clearance for the various styles and sizes of the vertical frame members and any brackets or other attachments on their lower ends. The alignment bracket includes a pair of opposing side members. The side members are spaced sufficiently apart that the vertical frame member fits between them. In addition, the side members extend sufficiently along the vertical length of the mast, such that a retained frame member is prevented from rotating relative to the mast.

A support platform is attached to the mast between a lower end and the alignment bracket. This platform is used to support a lower edge of the display sign. The support platform may be configured to include a socket or slot for receiving a portion of the sign's lower edge. In this way, the sign may be advantageously secured while resting on the support platform. The support platform eliminates the vertical load otherwise carried by the retaining device.

A retaining clamp is used to hold the vertical frame member against the mast. The clamp retains the frame member within the alignment bracket. An opening is advantageously provided within an outer wall of the mast, just behind the alignment bracket. A tightening member, used in conjunction with the retaining clamp, is configured such that it may be inserted within this opening when clamping the sign against the mast. In this fashion, the clamp retains the frame member within the side walls of the alignment bracket and is itself prevented from moving relative to the mast.

In yet another aspect of the present invention, a universal sign holding assembly is provided for mounting and supporting a flexible display sign. The universal sign holding assembly comprises a supporting base having a plurality of outwardly extending legs and an upright portion or post. Each of the legs are coupled to the base and are selectively operative for engaging with the ground. The legs are used to maintain the base at a predetermined attitude in relation to the ground. An elongate mast, which includes a lower section and an upper section, is adapted such that the lower section is removably connectable with the upright portion of the base. The upper section extends upwardly, in a generally vertical direction, from the lower section and away from the base.

An alignment bracket is attached to the upper section of the mast. This bracket includes a pair of spaced-apart, and generally vertically oriented, opposing side members. The side members retain the vertical frame member and prevent its lateral movement or rotation relative to the mast. A clamp is used for retaining the vertical frame member against the mast and within the side members of the alignment bracket. A support platform is provided on the mast between the lower end and the alignment bracket. This platform is used for capturing and supporting the lower edge of the sign.

The invention, together with additional features and advantages thereof, will become more apparent to those of skill in the art upon reading the description of the preferred embodiments, which follows in this specification, taken together with the following drawings.

DESCRIPTION OF THE PREFERRED EMBODIMENTS

Figure 1:
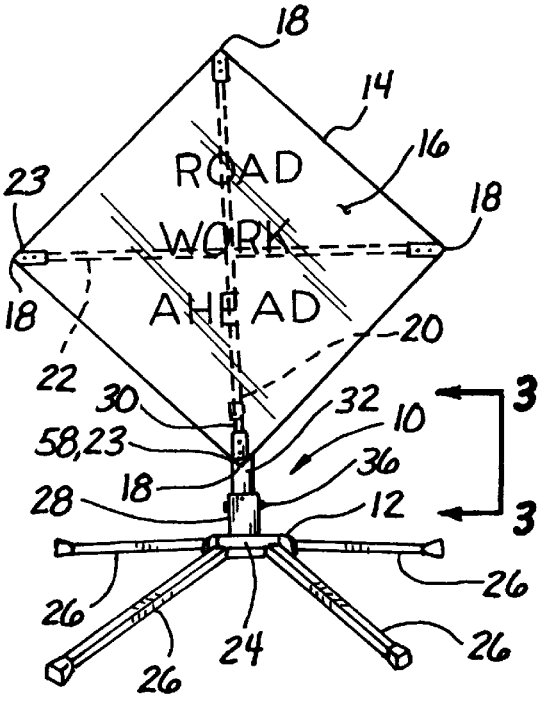
FIG. 1 is a perspective view of a display sign mounted to a sign supporting base using the universal sign holder of the present invention.

Referring now with more particularity to the drawings, FIG. 1 illustrates an embodiment of a universal sign holder 10 according to the principles of the present invention. As shown, the universal sign holder 10 is mounted on a conventional sign supporting base 12 and supports a display sign 14. As discussed supra, in the Background of the Invention portion of this specification, it is often desirable to use temporary message display signs, which are compact and easily transportable, yet are large enough to adequately display the desired message. For example, highway workers often deploy such portable, temporary signs when required road repairs necessitate working adjacent to a traffic lane, to alert oncoming drivers to the approaching hazard.

Flexible, roll-up signs, fabricated from a fabric or a plastic and as known to those of skill in the art, are often used in such instances because they are light, compact and occupy very little storage space in the utility vehicle. These flexible signs are often used for construction projects as well, particularly for temporary projects such as repairing roadways or other passageways.

The conventional construction of such a roll-up sign 14, as shown in FIG. 1, is to attach a message panel 16 at its corners or edges 18 to the ends of vertical frame member 20 and horizontal frame member 22. Preferably, each of the edges 18 of the message panel 16 is connected to an end of each frame member 20 and 22. This connection may be made using a plastic corner pocket 23, or similar device, as is known to those skilled in the art.

The frame members 20 and 22 are preferably constructed from a glass fiber material, such as a pultruded glass fiber reinforced polyester plastic (i.e. polyglass) or other glass reinforced plastic (GRP). As previously discussed, the frame members 20 and 22 may be of various lengths, depending upon the size of the message panel 16, but would typically have a standard width of approximately 1.25 inches and a standard thickness of approximately 0.38 inches or less.

The sign supporting base 12 generally comprises a base 24 and a plurality of outwardly extending legs 26 which are coupled to the base 24. Preferably, each of the legs 26 is selectively operative such that it may engage the ground while maintaining the sign supporting base 12 at a predetermined attitude in relation to the ground. An upright portion 28, which may be a post, or alternatively, a receiving bracket, may be centrally disposed on the base 24. The upright portion 28 is preferably made from a section of a metal tubing, such as square tubing, though other materials and cross-sectional configurations may be utilized in conjunction with the present invention. The universal sign holder 10 of the present invention is attached to the upright portion 28 or alternatively, to the receiving bracket and used to support the sign 14 in the display configuration as shown.

Figure 3:
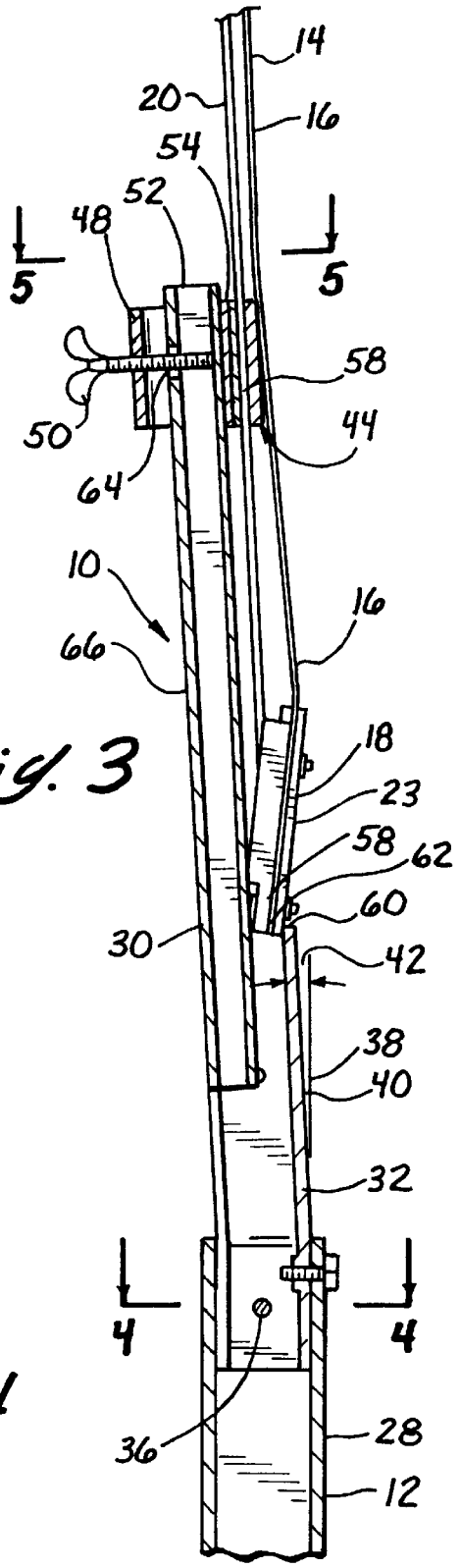
FIG. 3 is a partial cross-sectional view of the universal sign holder of FIG. 1 taken along lines 3—3.
Figure 4:
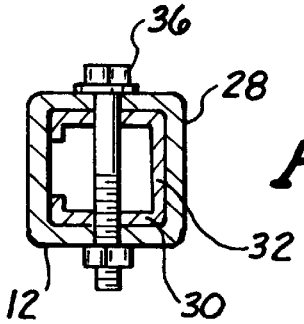
FIG. 4 is a cross-sectional view of the universal sign holder of FIG. 3 taken along lines 4—4.
Figure 2:
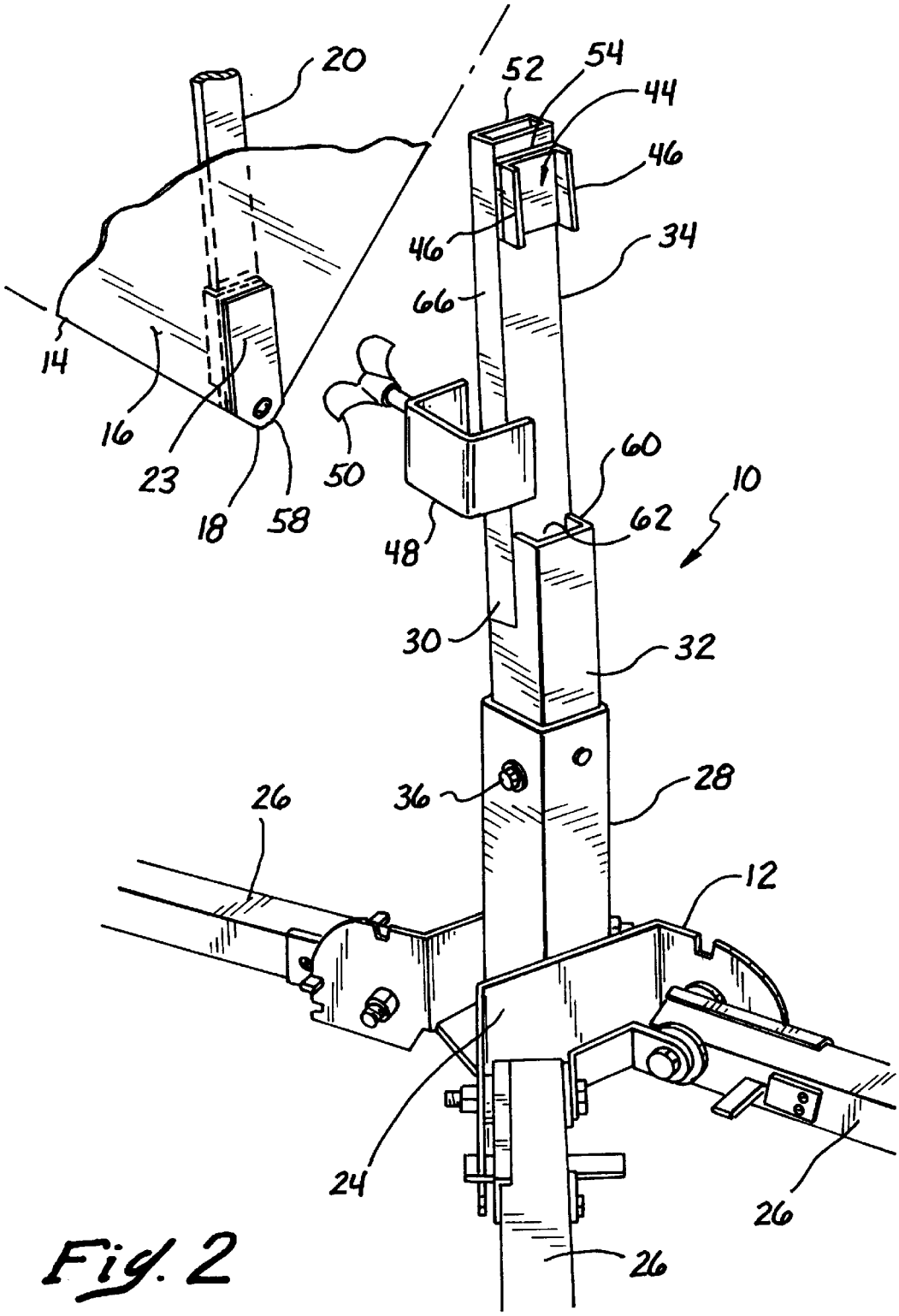
FIG. 2 is a partial perspective view of a preferred embodiment of a universal sign holder according to the present invention.

Referring now to FIGS. 2–5, the universal sign holder 10 will be described in greater detail. Preferably, the universal sign holder 10 includes an elongate mast 30 which extends between a lower section 32 and an upper section 34. The lower section 32 is advantageously adapted for connection with the sign supporting base 12. Thus, the lower section 32 may be configured such that it may be directly connected to the upright portion 28 on the sign supporting base 12. Preferably, the lower section 32 comprises a section of tubing which is configured to fit inside the upright portion 28 as shown in FIG. 4. As shown, the lower section 32 comprises a section of square tubing which has a smaller diameter than the square tubing section of the upright portion 28. Alternatively, the lower section 32 may be configured to slide over the upright portion 28. In a similar fashion, the lower section 32 may comprise a section of round tubing which slides inside, or alternatively, outside and over, a round upright portion 28 on the sign supporting base 12. The lower section 32 may then be secured to the sign supporting base 12 using a fastener 36 or similar retaining device as is known to those of skill in the art.

In yet another aspect of the present invention, the lower section 32 may be provided with a base plate or other mounting bracket on its lower end for direct connection with the sign supporting base 12. A fastener 36, or plurality of fasteners, may be used to secure the lower section 32 of the mast 30 to the sign supporting base 12. Preferably, the fastener 36 is a common fastener, such as a bolt or screw, however any other fastening or retaining device and means may be used as is known to those of skill in the art.

The elongate mast 30 extends upwardly from the lower section 32 on the sign supporting base 12 into the upper section 34. Preferably, the elongate mast 30 extends upwardly and away from the base 24 in a generally vertical orientation. In this way, the sign 14, and more importantly, the message panel 16 are appropriately supported for visual display.

In a preferred embodiment, the lower section 32 is oriented along a first axis 38 and the upper section 36 is oriented along a second axis 40 (FIG. 3). The second axis 40 may be oriented at an angle 42 rearward relative to the first axis 38. In this fashion, the display sign 14 may be oriented such that it is tilted rearwardly. Preferably, the angle 42 is between approximately two degrees and approximately ten degrees, and more preferably between three and five degrees.

An alignment bracket 44 may be attached to the mast 30 on the upper section 36. This alignment bracket 44 is used to retain the vertical frame member 20 of the sign 14 relative to the mast 30. The alignment bracket 44 may include a pair of spaced-apart and generally opposed side members 46. Preferably, each of the side members 46 is aligned relative to the mast 30 such that when the vertical frame member is maintained within the alignment bracket 44, it is also retained between each of the opposing side members 46. In this fashion, the vertical frame member 20, and more importantly the display sign 14, are prevented from rotating or moving laterally relative to the mast 30. Thus, each side member 46 should be of sufficient length and height to prevent rotation or lateral movement of the vertical frame member 20 relative to the mast 30. Preferably, each side member 46 is at least one inch in length. Alternatively, a plurality of spaced-apart alignment brackets 44 having vertical side members 46 of varying size may be used.

A retaining device 48 (FIGS. 3 and 5) may be used for removably maintaining the vertical frame member 20 within the alignment bracket 44. Preferably, the retaining device 48 compresses the vertical frame member 30 against the mast 20. In this fashion, the vertical frame member 20 is preferably retained within the alignment bracket 44 such that the opposing side members 46 prevent rotation or other lateral movement relative to the mast 30. Preferably, the compressive force exerted by the retaining device 48 is also sufficient to support the weight of the sign 14 and prevent movement along the longitudinal axis of the mast 30.

The retaining device 48 may be a clamp, such as a clamp with an open section for receiving the mast 30 and the vertical frame member 20 as shown in FIG. 3. With this configuration, the clamp 48 may be inserted around the mast 30 while capturing the vertical frame member 20 within the clamp. A tightening device 50 may be used to compress the vertical frame member 20 against the mast 30. This tightening device 50 may comprise a fastener, spring and push rod assembly, screw, or any other tightening or compressing device for use with a clamp as is known to those of skill in the art. For purposes of this invention, the clamp 48, may have a C-clamp configuration, but could comprise any similar type clamp, such as a U-shaped clamp, a square clamp, or any other clamp which may be utilized to retain the vertical frame member 20 against the mast 30. Preferably, the clamp 48 and the tightening member 50 together have sufficient width to evenly distribute the associated compressive forces against the mast 30 and the vertical frame member 20, such width preferably being at least one inch. Alternatively, any other type of retaining device 48 may be used for compressing the vertical frame member 20 against the mast 30 as is known to those of skill in the art.

In a preferred embodiment, the alignment bracket 44 is positioned on the upper section 36 of the mast 30 and more preferably, on an upper end 52 of the mast 30. By positioning the alignment bracket 44 closer to the upper end 52 of the mast 30, the rotation and lateral movement of the vertical frame member 20, relative to the mast, are more effectively restrained.

A spacer 54 may be provided between the alignment bracket 44 and the mast 30 such that the alignment bracket 44 is spaced outwardly and apart from the mast 30. With a spacer 54, the vertical frame member 20 is retained in the alignment bracket 44 in a spaced apart fashion from the mast 30. This clearance or spacing may be necessary when using various types of vertical frame members 30, some of which have a corner pocket 23 or other attached device on their edges 18. The pocket 23 or other attached device typically have a thickness which extends on either side of the frame member 20 and thus prevents the frame member 20 from laying flat against the mast 30.

The spacer 54 is preferably of sufficient thickness that when the vertical frame member 20 is compressed against the mast 30, bending forces on the frame member 20 are minimized and the frame member 20 is maintained generally parallel to the second axis 40 of the mast 30.

Preferably, the spacer 54 is approximately one eighth to one third inch in thickness. This thickness generally corresponds to the thickness of the pocket 23 which extends inside of the frame member 20. Spacing may also be achieved through the use of various embodiments of the alignment bracket 44. For example, the alignment bracket 44 may be configured with sufficient thickness that it forms an integral spacing between the mast 30 and the vertical frame member 20. This configuration of alignment bracket 44 may reduce or eliminate the need for any further spacing or spacers 54.

A support platform 60 may be provided on the mast 30 to assist in supporting the sign 14. This support platform 60, which may be a bracket, is attached to the mast 30 between the lower section 32 and the upper section 34. In this fashion, the support platform 60 may be used as a rest for the lower edge 58 of the display sign 14. Preferably, the support platform 60 is located much lower on the mast 30 than the alignment bracket 44 such that any rotational forces on the display sign 14 are effectively restrained. In addition, the support platform 60 may be fitted with a socket 62 or other opening for receiving the lower edge 58 of the display sign 14.

In addition to resisting rotation and lateral movement of the display sign 14 relative to the longitudinal axis of the mast 30, the support platform 60 also reduces or eliminates the need for the retaining device 48 to support the weight of the sign 14 or any other longitudinal loads. The support platform 60 may comprise any bracket, such as an angled bracket, which has a base or platform for supporting the vertical frame member 20. As mentioned, the support platform 60 preferably includes a socket 62. Thus, the base or platform must be large enough to structurally support the sign 14 while retaining the corner pocket 23 of the lower edge 58 within the socket 62.

In a preferred embodiment, the support platform 60 is provided on the mast 30 at the junction of the lower section 32 and the upper section 34. In this configuration, the lower section 32 may comprise a piece of tubing having a first width. The upper section 34 may comprise a second section of tubing having a different width and connected to the lower section 32. By providing the lower section 32 with a greater width than the upper section 34, a socket 62 may be formed. Preferably, the tubing is square tubing, however, it is to be understood that various sizes, materials and cross-sectional shapes may be used in order to configure such a socket 62. It should also be understood, that any form or configuration of support platform 60 may be utilized which provides a rest for the lower edge 58 of the vertical frame member 20. This support platform 60 may be an integral part of the mast 30 as previously discussed, or alternatively configured as a bracket which is attached to the mast 30 using welding, fasteners, rivets, or similar.

Figure 5:
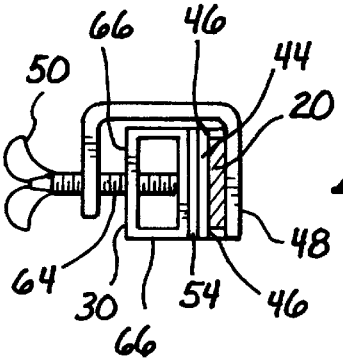
FIG. 5 is a cross-sectional view of the universal sign holder of FIG. 3 taken along lines 5—5.

In order to prevent the retaining device 48 from inadvertently moving from its secured position relative to the mast 30, an opening or aperture 64 may be configured within the mast 30 (FIG. 5). This opening 64 is used to prevent the movement of the retaining device 48 relative to the mast 30. Preferably, this opening 64 comprises an aperture through a side 66 of the mast 30 which is sufficiently sized to receive the tightening member 50. More preferably, the opening 64 is through the rear side 66 of the mast 30 as shown in FIG. 5. In this way, the retaining device 48 is prevented from coming off under lateral loads which may be encountered or alternatively, from sliding along the mast 30. A second retaining device (not shown) may also be provided to secure the retaining device 48 to the mast 30.

The opening 64 may be located in a centered position, behind the alignment bracket 44, such that the installed retaining device 48 may be centered and secured over the alignment bracket 44. This permits the retaining device 48 to secure and maintain the vertical frame member 20 within the alignment bracket 44 as shown in FIG. 5. Alternate configurations for securing the retaining device 48 to the mast 30 may also be used. For example, the mast 30 may be provided with a retaining bracket, a cutout portion, or other configurations which support and secure the retaining device 48 relative to the mast 30.

It will be understood that various modifications may be made to the various embodiments of the present invention herein disclosed without departing from the spirit and scope thereof. For example, various sizes of the universal sign holder are contemplated as well as various types of construction materials. Also, various modifications may be made in the configuration of the parts and their interaction. Therefore, the above description should not be construed as limiting the invention, but merely as an exemplification of preferred embodiments thereof. Those of skill in the art will envision other modifications within the scope and spirit of the present invention as defined by the claims appended hereto.

What is claimed is:

1. A universal sign holder for mounting a display sign having a message panel supported by a vertical frame member on a sign supporting base, said universal sign holder comprising:

a mast having a lower section and an upper section, said lower section being adapted for connection with the sign supporting base and said upper section extending upwardly above said lower section;

an alignment bracket attached to said mast, said alignment bracket having a pair of spaced apart and generally opposing side members, said spaced side members being adapted to retain said vertical frame member therebetween so that the vertical frame member is prevented from rotating or moving laterally relative to said mast; and a retaining device for retaining said vertical frame member against said mast and within said alignment bracket, said retaining device comprising a member having a first portion which engages said pair of spaced side members to create a channel together with said spaced side members for retaining said vertical frame member, and a second portion having a tightening member for compressing said vertical frame member against said mast.

2. The universal sign holder as recited in claim 1 wherein said tightening member comprises a clamp.

3. The universal sign holder as recited in claim 1 wherein said mast includes an opening such that at least part of said retaining device is insertable through said opening.

4. The universal sign holder as recited in claim 3 wherein said opening is disposed on an opposing side of said mast relative to said alignment bracket such that said retaining device retains said vertical frame member within said alignment bracket.

5. The universal sign holder as recited in claim 1, and further comprising a spacer for spacing said alignment bracket apart from said mast.

6. The universal sign holder as recited in claim 1 wherein said mast further comprises a support platform for supporting a lower edge of said sign.

7. A universal sign holder for mounting a display sign having a message panel supported by a vertical frame member on a sign supporting base, said universal sign holder comprising:

a mast having a lower section and an upper section, said lower section being adapted for connection with the sign supporting base and said upper section extending upwardly above said lower section;

an alignment bracket attached to said upper section of said mast and having a pair of spaced apart and generally opposing side members, each side member being aligned relative to said mast such that said vertical frame member is retained between said opposing side members and prevented from rotating or moving laterally relative to said mast; and a retaining device for removably retaining said vertical frame member within the side members of said alignment bracket;

wherein said lower section of said mast is oriented along a first axis and said upper section of said mast is oriented along a second axis.

8. The universal sign holder as recited in claim 7 wherein said first axis is oriented at an angle of between approximately 2 degrees and approximately 10 degrees relative to said second axis.

9. The universal sign holder as recited in claim 7 wherein said alignment bracket is attached adjacent an upper end of said mast.

10. The universal sign holder as recited in claim 7, and further comprising a support platform for supporting a lower edge of said sign.

11. The universal sign holder as recited in claim 10 wherein said support platform includes a socket for receiving a portion of said lower edge.

12. A universal sign holding assembly for mounting and supporting a flexible display sign having a message panel supported by at least one vertical frame member which extends from a lower edge of said sign, said universal sign holding assembly comprising:

a base;

a plurality of legs coupled to the base and selectively operative to engage the ground while maintaining the base at a predetermined attitude in relation to the ground;

a mast having a lower section and an upper section, said lower section adapted for connection with said base and said upper section extending upwardly and away from said base;

an alignment bracket attached to said upper section of said mast, said alignment bracket having a pair of spaced apart and opposing side members for retaining said vertical frame member within said opposing side members; and a retaining device for securing said vertical frame member against said mast and within said alignment bracket, said retaining device comprising a member having a first portion which engages said pair of spaced side members to create a channel together with said spaced side members for retaining said vertical frame member, and a second portion having a tightening member for compressing said vertical frame member against said mast.

13. The universal sign holding assembly as recited in claim 12 wherein said tightening member is a clamp.

14. The universal sign holding assembly as recited in claim 12 wherein said alignment bracket is disposed adjacent an upper end of said mast.

15. The universal sign holding assembly as recited in claim 14 wherein said mast further comprises a support platform for supporting the lower edge of said sign.

16. The universal sign holding assembly as recited in claim 15, wherein said support platform includes a socket and wherein said socket is configured for receiving a portion of said lower edge.

17. A universal sign holder for mounting a display sign having a message panel supported by a vertical frame member on a sign supporting base, said universal sign holder comprising:

a mast having a lower section and an upper section, said lower section being adapted for connection with the sign supporting base and said upper section extending upwardly above said lower section;

an alignment bracket attached to said upper section of said mast and having a pair of spaced apart and generally opposing side members, each side member being aligned relative to said mast such that said vertical frame member is retained between said opposing side members and prevented from rotating or moving laterally relative to said mast; and a retaining device for removably retaining said vertical frame member within the side members of said alignment bracket;

wherein said support platform includes a socket for receiving a portion of a lower edge of said sign.

* * * * *